United States Patent [19]

Benjamin

[11] Patent Number: 4,566,646

[45] Date of Patent: Jan. 28, 1986

[54] TAKE-UP MACHINE MOTOR CONTROL

[75] Inventor: Kenneth A. Benjamin, Greensboro, N.C.

[73] Assignee: Leesona Corporation, Warwick, R.I.

[21] Appl. No.: 609,113

[22] Filed: May 11, 1984

[51] Int. Cl.[4] ..... B65H 59/38

[52] U.S. Cl. ..... 242/45; 242/75.51

[58] Field of Search ..... 242/45, 75.51

[56] References Cited

U.S. PATENT DOCUMENTS

| | | | |
|---|---|---|---|
| 2,275,192 | 3/1942 | Bailey | 242/45 |
| 2,752,105 | 6/1956 | Keith | 242/45 |
| 3,048,343 | 8/1962 | Keith | 242/45 |
| 3,537,660 | 11/1970 | Schippers et al. | 242/45 |
| 3,578,795 | 5/1971 | Polese | 242/45 |
| 3,670,975 | 6/1972 | Tomimatsu | 242/45 |

FOREIGN PATENT DOCUMENTS

| | | | |
|---|---|---|---|
| 1145907 | 3/1969 | United Kingdom | 242/45 |

*Primary Examiner*—Stanley N. Gilreath

*Attorney, Agent, or Firm*—B. W. Norton

[57] ABSTRACT

This invention relates to a take-up machine utilized in conjunction with the production of fiber or yarn wherein the product fiber or yarn, as it is produced, is wound onto spools or tubes. A control is provided for varying the speed of an electric motor which drives a spindle on which the tube or spool is mounted. This control is actuated by the position of a compensator arm which is connected to a core of a linear voltage differential transformer which, in turn, controls current flow through an NPN power transistor. The power transistor, in turn, controls current flow through a rectifier having one circuit for each of three windings of a three-phase AC motor, thereby controlling the speed of rotation of the motor.

18 Claims, 2 Drawing Figures

TAKE-UP MACHINE MOTOR CONTROL

FIELD OF INVENTION

A take-up machine is used in the textile industry to wind fibers or yarn which are continuously delivered from a suitable source, such as a chemical process. The speed of the fiber or yarn is up to 500 to 2000 yards per minute, depending upon the material and the process equipment.

The take-up machine includes a mechanical structure which mounts a spindle on a rotating shaft and, with pulleys and intermediate rotating shafts, is driven with belts by an electric drive motor.

The take-up machine also includes a mechanism in the form of a system of guide pieces which thread the yarn over a moving arm and onto the rotating spindle. The rotating spindle is designed to clamp or hold a removable cardboard or plastic tube or spool. This tube or spool acts as the core for the wound yarn package. As the yarn is wound on the tube, the moving arm rotates according to the speed of winding or take-up of the material. The moving arm provides the mechanical means to control the speed of the spindle to properly match the speed of the spun fiber being delivered from the process. This moving arm is generally called the "compensator arm" and is mechanically limited to approximately 90 degrees of travel.

CURRENT EMBODIMENT PRIOR TO INVENTION

The drive motor of the currently employed take-up mechanism is a three-phase induction torque motor and is designed to provide control of torque rather than constant speed. The torque is controlled by adjusting the current flow in the motor windings.

In the current embodiment, adjustment of the motor winding currents has been accomplished by varying the value of resistance in the individual windings using a mechanical transducer. The mechanical transducer contains twenty pairs of contacts which add or remove resistance to the motor windings in response to the mechanical position of the compensator arm. When the compensator arm falls indicating that more speed is required to balance the oncoming speed of yarn, the transducer is driven to remove resistance from the winding circuits, thereby increasing speed.

Since the transducer contacts are handling motor currents directly, the contacts are subject to arcing thereby requiring frequent replacement and become a maintenance nuisance.

In accordance with this invention there is provided a solid state control unit which is free of mechanical contacts.

Another feature of the invention is the elimination of energy consuming resistors from the control system.

The solid state control system of the present invention includes a rectifier circuit for controlling flow through the motor windings, with current flow through the rectifier circuit being controlled by a power transistor which, in turn, is controlled by a solid state transducer which is directly operated by the compensator arm position of the take-up machine.

Figure 1:
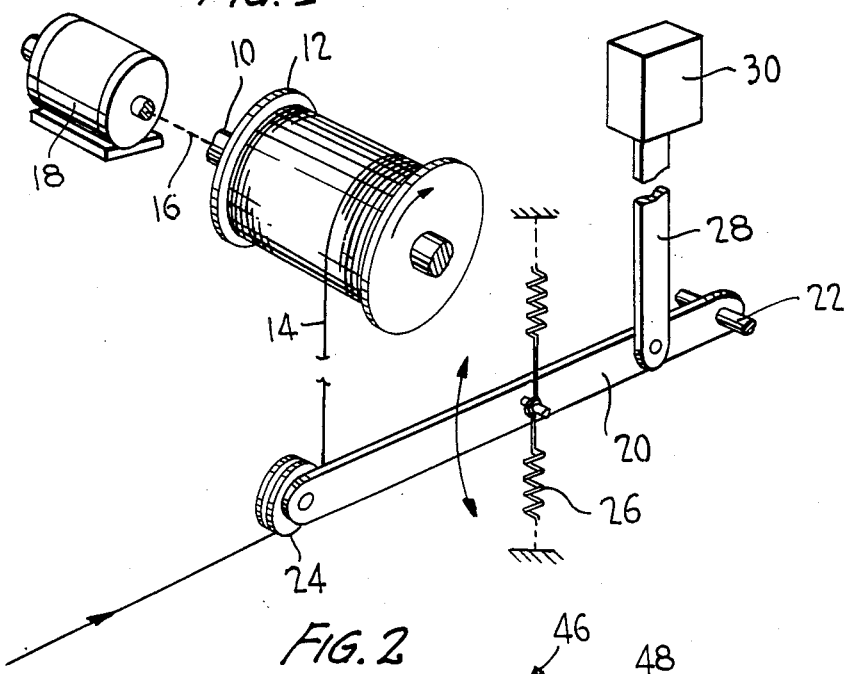
Figure 2:
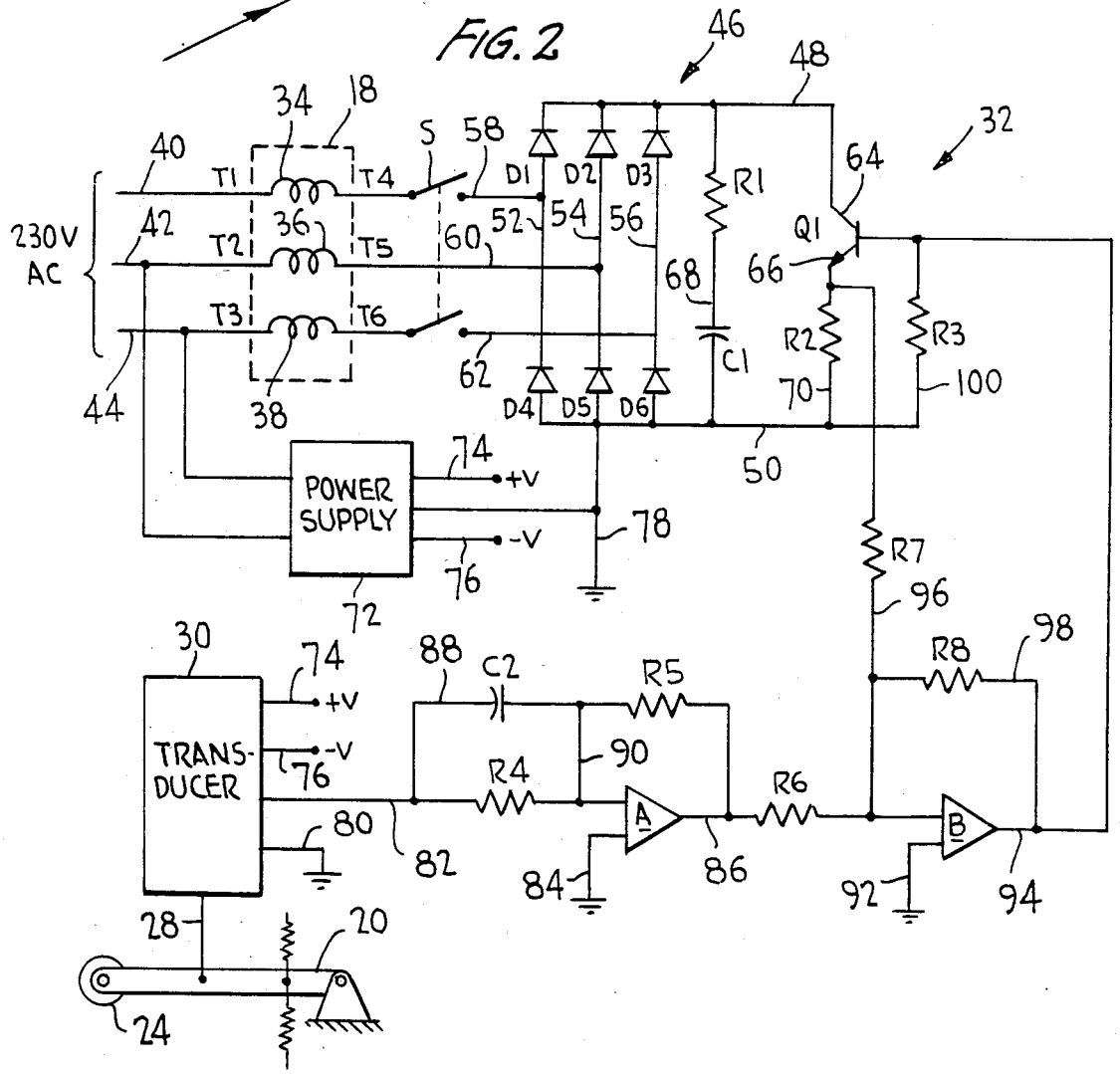

Having described the invention in general terms, a preferred embodiment of the invention will be described with regard to the drawing wherein FIG. 1 is a perspective view showing the environment of the control of this invention; and FIG. 2 is a wire schematic showing the specific details of the solid state control system.

Referring now to the drawings in detail, it will be seen that as illustrated in FIG. 1 a spindle 10 on which there is removably mounted a spool or tube 12 onto which fiber or yarn 14 is wound in large quantities at high speed.

The spindle 10 is mounted on a suitable shaft 16 which in the embodiment of FIG. 1 is illustrated as being directly driven by an electric motor 18. However, in the actual embodiment of the invention, the motor 18 drives the shaft 16 through a series of belts and pulleys, the illustration of which is not required for an understanding of this invention.

The fiber or yarn 14 is received directly from a forming operation at a speed in accordance with the forming operation. In accordance with this invention it is necessary to rotate the tube 12 at a speed wherein the yarn 14 is wound thereon at the same rate as it is produced. Of course, as the effective diameter of the spool 12 increases, a lesser speed of rotation will be required.

It is conventional to provide the take-up machine with a compensator arm 20 which is mounted on a pivot 22 and which carries a rotatable guide 24 remote from the pivot 22. The compensator arm 20 is normally maintained in a central position by a spring mechanism 26, but is free to pivot in accordance with variation in tension in the yarn 14. In one embodiment, when the tension in the yarn 14 is insufficient, the compensator arm 20 will be in a neutral position. As the tension increases, the compensator arm 20 will move upwardly to a normal operating position. If the tension is too great, the compensator arm 20 will move upwardly further than the normal position. If the tension is too low, the compensator arm will fall back towards a lower position. In another embodiment, the neutral position can be the normal operating position. If the tension is too great, the compensator arm will move above the normal operating position, and if the tension is too low it will fall below the normal operating position.

The compensator arm 20 carries a control link 28 which will be connected to a core of a transducer 30 which is a control element of a solid state control circuit for the electric motor 18.

In the present invention, the transducer 30 is a linear voltage differential transformer, LVDT. An iron slug in the core of the LVDT provides a low level signal which is proportional to its linear position. An electronic circuit in the transducer converts the LVDT signal to a level and polarity sense that can be effectively used as an input to the solid state control unit.

The control system as shown in FIG. 2, which is generally identified by the numeral 32, is specifically adapted for a three-phase electric motor, such as the motor 18. The motor 18 includes three windings 34, 36, and 38, with the winding 34 extending between terminals T1 and T4, the winding 36 extending between terminals T2 and T5, and the winding 38 being connected between terminals T3 and T6.

A 230 volt AC, three-phase power supply is connected to the terminals T1, T2, and T3 by way of leads 40, 42, and 44, respectively.

The solid state control circuit 32 also includes a rectifier, generally identified by the numeral 46. The rectifier 46 includes parallel leads 48 and 50 between which there are connected in parallel relation lines 52, 54, and 56.

The line 52 has incorporated therein diodes D1 and D4 which are arranged for current flow in the same direction. Intermediate the diodes D1 and D4, a line 58 leading from terminal T4 is coupled.

The line 54 has coupled therein diodes D2 and D5, and coupled to the line 54 between these two diodes is a line 60 from the terminal T5.

Also, the line 56 has incorporated therein diodes D3 and D6, and coupled to the line 56 between the diodes D3 and D6 is a line 62 from the terminal T6.

A double pole, single throw switch S is incorporated in the lines 58, 62 for selectively opening the circuit to the solid state control circuit 32.

The rectifier 46 is coupled to an NPN power transistor Q1, with the line 48 being coupled to the emitter 64, and the line 50 being coupled to the collector 66 of the transistor Q1.

In a further line 68 parallel to the lines 52, 54, 56, and between the rectifier 46 and the power transistor Q1 are a resistor R1 and a capacitor C1. The function of these elements will be described in detail hereinafter.

Further, in a line 70 between the collector 66 and the line 50 is a resistor R2 which will be described in detail hereinafter.

A power supply 72 is provided for the transducer 30, with the power supply receiving an input from the leads 42, 44, and providing a DC output through leads 74, 76 which provide a +V and −V output.

The power supply 72 and the rectifier 46 are connected to ground by a lead 78.

It is also to be noted that the transducer 30 is connected to ground by a line 80.

The transducer 30 has an output 82 which is connected to an input of a first amplifier A. The amplifier A is also connected to ground by a line 84 and has an output 86.

A resistor R4 is incorporated in the output 82 between the transducer 30 and the amplifier A.

A line 88 is coupled to the output 82 between the transducer 30 and the resistor R4, and has its opposite end connected to the output 86. A condensor C2 and a resistor R5 are incorporated in the line 88.

A line 90 connects the line 88 between the capacitor C2 and the resistor R5 to the output 82 between the resistor R4 and amplifier A.

The output 86 is connected to an input of a second-stage amplifier B. The amplifier B is connected to ground through a line 92 and further has an output 94 which is connected to the power transistor Q1 to provide a control signal for the transistor Q1.

It is to be noted that a resistor R6 is coupled in the output 86. Also, a line 96 is coupled to the output 86 between the resistor R6 and the input of the amplifier B. Line 96 is coupled to the line 70 between the resistor R2 and the power transistor Q1. A resistor R7 is incorporated in the line 96.

A line 98 extends between the line 96 and the output 94, with the line 98 being connected to the line 96 between the resistor R7 and the connection of the line 96 to the output 86. A resistor R8 is incorporated in the line 98.

The line 50 has an extension 100 which is connected to the output 94 adjacent the power transistor Q1 and has incorporated therein a resistor R3.

In operation, current flow through the motor windings 34, 36, 38 passes through the rectifier 46 and the DC output of the rectifier 46 is connected across the collector to the emitter of the NPN power transistor Q1. The level of current conduction of the transistor Q1, as controlled by the transducer 30, will control the level of current flow in the three windings 34, 36, 38 so as to control the speed of the drive motor 18.

Resistor R1 and capacitor C1 provide means for smoothing or filtering the motor winding currents to maintain a normal sinusoidal waveform condition during periods when the transistor Q1 may be turned off.

It is to be understood that the DC signal from the transducer 30 feeds through the output 82 into the amplifier A with resistors R4 and R5 and capacitor C2 adjusting the level of the signal from the transducer 30 to the amplifier A and, thus, providing a compensating action to obtain stable performance of the motor 18. The output of amplifier A feeds through output 86 into the amplifier B through resistor R6. Also, a signal proportional to power transistor Q1 current obtained from the voltage drop across resistor R2 is fed into the input of amplifier B through resistor R7. In this manner, amplifier B provides the control signal to the power transistor Q1 which is the net result of the transducer command signal and transistor Q1 current feedback signal.

The impact is that it has been found that the solid state control circuit 32 operates very effectively.

Although only a preferred embodiment of the solid state control system has been specifically illustrated and described herein, it is to be understood that minor variations may be made in the control system within the environment of use specifically illustrated and described without departing from the spirit and scope of the invention as defined by the appended claims.

It is claimed:

1. In a take-up machine of the type for winding fiber and yarn on spools and tubes with said take-up machine comprising a rotating spindle for receiving tubes and spools, an AC electric motor coupled to said spindle for rotating said spindle, and a tension take-up mechanism for controlling the speed of said electric motor in accordance with tension on fiber and yarn being wound; the improvement comprising said motor having plural windings, said windings being connected to a rectifier circuit, solid state control means for controlling current flow through said rectifier circuit and thereby current flow through each of said motor windings down to zero, said solid state control means including a linearly movable control element connected to said tension take-up mechanism for positioning thereby.

2. In a take-up machine according to claim 1, said solid state control means including a linear transducer and said linearly movable control element being a core of said linear transducer.

3. In a take-up machine according to claim 1 wherein said solid state control means includes a power transistor having an emitter and a collector, said rectifier circuit is connected across said emitter to said collector for the control of said rectifier circuit, and said linearly movable control element is operable to control current conduction of said power transistor.

4. In a take-up machine according to claim 3 wherein said power transistor is an NPN power transistor.

5. In a take-up machine according to claim 3, said solid state control means including a linear transducer and said linearly movable control means being a core of said linear transducer.

6. In a take-up machine according to claim 5 together with amplifier means between said linear transducer and said power transistor.

7. In a take-up machine according to claim 6 wherein said power transistor is an NPN power transistor.

8. In a take-up machine according to claim 6 wherein said amplifier means includes first and second amplifiers arranged in series.

9. In a take-up machine according to claim 6 wherein said amplifier means includes first and second amplifiers arranged in series, said second amplifier having an input joined to both an output of said first amplifier and to a feedback signal current from said power transistor.

10. In a take-up machine according to claim 6 wherein said amplifier means includes first and second amplifiers arranged in series, said second amplifier having an input joined to an output of said first amplifier, there being a resistor in the circuit from said rectifier across said power transistor, and said second amplifier input being connected to said power transistor for receiving a current feedback signal proportional to current of said power transistor obtained from a voltage drop across said resistor.

11. In a take-up machine according to claim 3 wherein there is a resistor and a capacitor in series with each other and in parallel to said rectifier current flow through said power transistor for filtering motor winding currents to maintaining a normal sinusoidal waveform condition during periods when said power transistor may be turned off.

12. In a take-up machine according to claim 1 wherein said rectifier includes a parallel circuit for each of said motor windings, each of said parallel circuits includes first and second diodes spaced from one another and coupled for current flow in a preselected direction, and each motor winding being coupled to the respective one of said parallel circuits between said diodes thereof.

13. In a take-up machine according to claim 12 wherein said solid state control means includes a power transistor having an emitter and a collector, said rectifier circuit is connected across said emitter to said collector for the control of said rectifier circuit, and said linearly movable control element is operable to control current conduction of said power transistor.

14. In a take-up machine according to claim 1 wherein there are three of said motor windings, and said motor is a three-phase torque motor.

15. In a take-up machine according to claim 12 wherein there are three of said motor windings, and said motor is a three-phase torque motor.

16. In a take-up machine according to claim 15 wherein said solid state control means includes a power transistor having an emitter and a collector, said rectifier circuit is connected across said emitter to said collector for the control of said rectifier circuit, and said linearly movable control element is operable to control current conduction of said power transistor.

17. In a take-up machine according to claim 16 wherein said power transistor is an NPN power transistor.

18. In a take-up machine according to claim 16, said solid state control means including a linear transducer and said linearly movable control means being a core of said linear transducer.

* * * * *